US009243795B2

(12) United States Patent
Hong et al.

(10) Patent No.: US 9,243,795 B2
(45) Date of Patent: Jan. 26, 2016

(54) MODULAR LIGHTING APPARATUS AND METHOD OF MANUFACTURING THE SAME

(71) Applicant: LG ELECTRONICS INC., Seoul (KR)

(72) Inventors: Younggun Hong, Seoul (KR); Seoyoung Jeong, Seoul (KR); Hyunha Kim, Seoul (KR); Namjin Kim, Seoul (KR); Yunjin Yim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 31 days.

(21) Appl. No.: 14/088,758

(22) Filed: Nov. 25, 2013

(65) Prior Publication Data

US 2014/0168990 A1 Jun. 19, 2014

(30) Foreign Application Priority Data

Dec. 18, 2012 (KR) ..... 10-2012-0148270

(51) Int. Cl.

| | |
|---|---|
| ***F21V 29/00*** | (2015.01) |
| ***F21V 29/71*** | (2015.01) |
| ***F21V 29/73*** | (2015.01) |
| *F21K 99/00* | (2010.01) |
| *F21V 23/00* | (2015.01) |

(52) U.S. Cl.

CPC ..... *F21V 29/267* (2013.01); *F21K 9/137* (2013.01); *F21V 29/713* (2015.01); *F21V 29/73* (2015.01); *F21K 9/135* (2013.01); *F21V 23/006* (2013.01); *Y10T 29/49002* (2015.01)

(58) Field of Classification Search

CPC ..... F21K 9/13; F21K 9/135; F21K 9/137; F21V 23/006; F21V 3/02; F21V 29/267; F21V 29/713; F21V 29/07

USPC ..... 362/294, 373, 547, 646; 313/318.01

See application file for complete search history.

(56) References Cited

U.S. PATENT DOCUMENTS

| | | | | |
|---|---|---|---|---|
| 7,234,842 | B2 * | 6/2007 | Frederico | 362/277 |
| 8,591,062 | B2 * | 11/2013 | Hussell et al. | 362/249.01 |
| 8,602,579 | B2 * | 12/2013 | Van De Ven et al. | 362/96 |
| 8,662,732 | B2 * | 3/2014 | Broitzman | 362/640 |
| 8,764,248 | B1 * | 7/2014 | Simon | 362/294 |
| 8,773,007 | B2 * | 7/2014 | Van De Ven et al. | 313/318.01 |
| 2006/0098440 | A1 * | 5/2006 | Allen | 362/294 |

* cited by examiner

*Primary Examiner* — Anh Mai
*Assistant Examiner* — Arman B Fallahkhair
(74) *Attorney, Agent, or Firm* — Ked & Associates, LLP

(57) ABSTRACT

Disclosed are a modular lighting apparatus and a method of manufacturing the same. The modular lighting apparatus may be configured such that a volume of a heat radiating module may easily be changed to satisfy standards established by a variety of products groups. An optical module is configured to be interchangeable to provide different form factors that conform to different standards. The modular configuration and associated method of manufacturing the modular lighting apparatus provides enhanced assembly efficiency as well as reduced manufacturing costs.

20 Claims, 8 Drawing Sheets

MODULAR LIGHTING APPARATUS AND METHOD OF MANUFACTURING THE SAME

CROSS-REFERENCE TO RELATED APPLICATION(S)

Pursuant to 35 U.S.C. §119(a), this application claims the benefit of Korean Patent Application No. 10-2012-0148270, filed on Dec. 18, 2012, which is hereby incorporated by reference as if fully set forth herein.

BACKGROUND

1. Field

The present disclosure relates to a modular lighting apparatus and a method of manufacturing the same, and more particularly to a modular lighting apparatus which may easily vary a volume of a heat radiating module to satisfy standards established by a variety of products groups, and which achieve enhanced assembly efficiency as well as reduced manufacturing costs, and a method of manufacturing the same.

2. Background

Generally, light sources used primarily for lighting equipment are incandescent lamps, discharge lamps, fluorescent lamps, and the like for various purposes, such as home, landscape, industrial use, and the like. Among the aforementioned types of light sources, a resistive light source, such as, for example, an incandescent lamp, has low efficiency and serious heat radiation problems, a discharge lamp may be expensive and have high voltage problems, and a fluorescent lamp presents an environmental problem due to use of mercury.

To solve the problems of the aforementioned light sources, interest in Light Emitting Diode (LED) lighting equipment that has many advantages, including high efficiency, color diversity, design freedom, and the like, is increasing. LEDs are semiconductor devices that emit light when a forward voltage is applied thereto, and have an extended lifespan, low power consumption as well as electrical, optical, and physical characteristics suitable for mass production. Hence, incandescent lamps and fluorescent lamps are being replaced with LEDs.

LED lighting apparatuses are designed based on shape criteria defined in standards. The standards may be American National Standards Institute (ANSI) standards. For example, A, G, PS, PAR, and R products groups, assembled in an E-base manner, are manufactured as heat sinks having a predetermined volume by ANSI standards.

Manufacture of various lighting apparatuses based on shape criteria defined, for example, in ANSI standards requires additional production lines equal in number to the product groups. Thus, facilities and costs for the manufacture of lighting apparatuses may disadvantageously increase.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
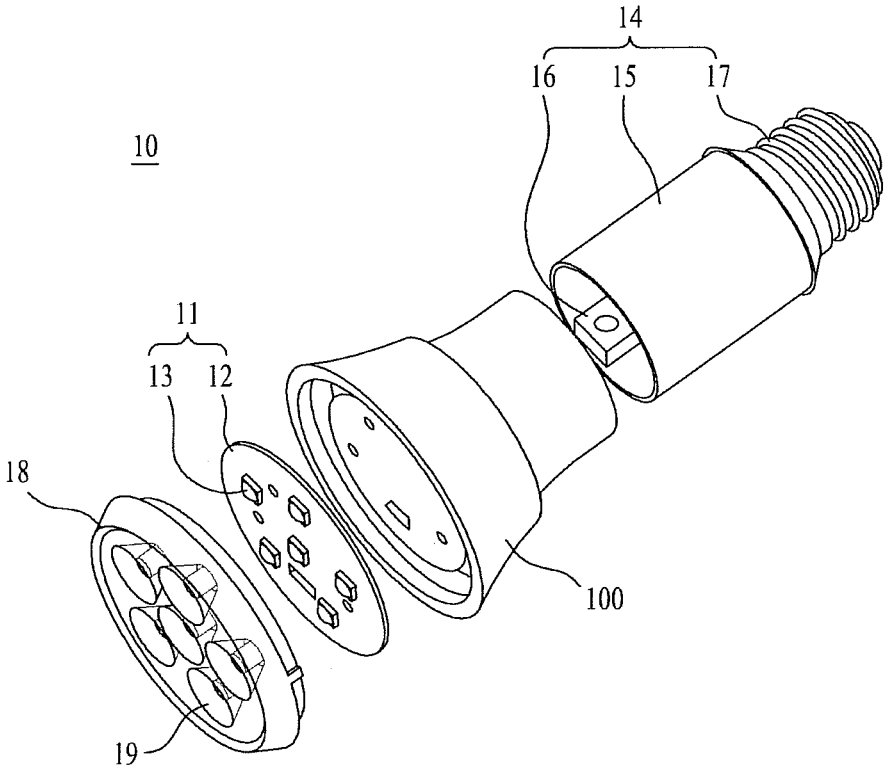
FIG. 1 is an exploded perspective view of a modular lighting apparatus corresponding to one product group according to the present disclosure.

Hereinafter, a modular lighting apparatus and a manufacturing method thereof according to the embodiment of the present disclosure will be described in detail with reference to the accompanying drawings. The accompanying drawings show an exemplary configuration of the present disclosure and are provided for more detailed explanation of the present disclosure, and the technical sprit of the present disclosure is not limited thereto.

In addition, the same or similar elements are denoted by the same reference numerals even though they are depicted in different drawings, and a repeated description thereof will be omitted. In the drawings, for convenience of explanation, sizes and shapes of respective constituent members may be enlarged or reduced.

It will be understood that, although the terms first, second, etc. may be used herein to describe various components, these components should not be limited by these terms. These terms are used simply to discriminate any one component from other components.

Provided is a modular lighting apparatus, in which a volume of a heat radiating module may easily be varied to satisfy standards established by a variety of product groups and achieve enhanced assembly efficiency by using a fewer number of modules that may be designed for common use, and a method of manufacturing the same.

Figure 2:
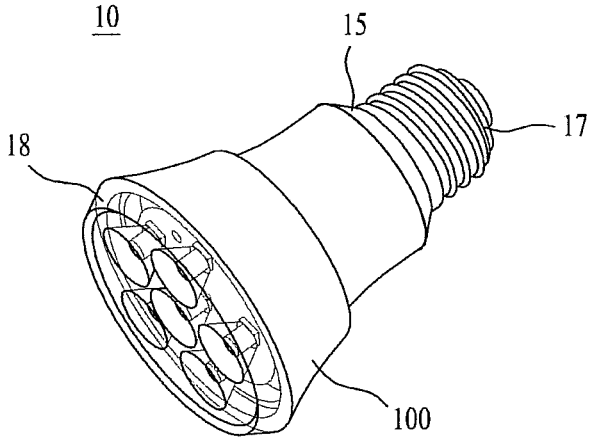
FIG. 2 is a perspective view showing an assembled state of modules shown in FIG. 1.

FIG. 1 is an exploded perspective view of a modular lighting apparatus 10 having a prescribed configuration according to the present disclosure, and FIG. 2 is a perspective view showing an assembled state of modules shown in FIG. 1. The prescribed configuration may be based on a specific set of specifications as set forth in a certain standard or set by a product group. The modular lighting apparatus 10 may include a heat radiating module 100 having a predetermined volume, a light emitting module 11 which may include a substrate 12 mounted on the heat radiating module 100 and LEDs 13 arranged on the substrate 12, a power module 14 which may include a housing 15 mounted to the heat radiating module 100 and an electric unit 16 placed in the housing 14 to supply power to the light emitting module 11, and an optical module 18 which may be configured to surround the light emitting module 11 and mounted to the heat radiating module 100.

Referring to FIGS. 1 and 2, the modular lighting apparatus 10 may be a Parabolic Aluminized Reflector (PAR) type. In this case, the optical module 18 may be a lens unit (or lens assembly). The lens unit may include collecting lenses 19 to guide the direction of light emitted by the LEDs 13. Here, the collecting lenses 19 may function to control a beam angle of the modular lighting apparatus 10. For example, the light emission angle and/or pattern may be controlled using the lens unit. Here, the beam angles may correspond to light emission angles or patterns. Moreover, a power socket 17 may be provided to connect to an external power device. The power socket 17 may be referred to as an E-base.

Figure 3:
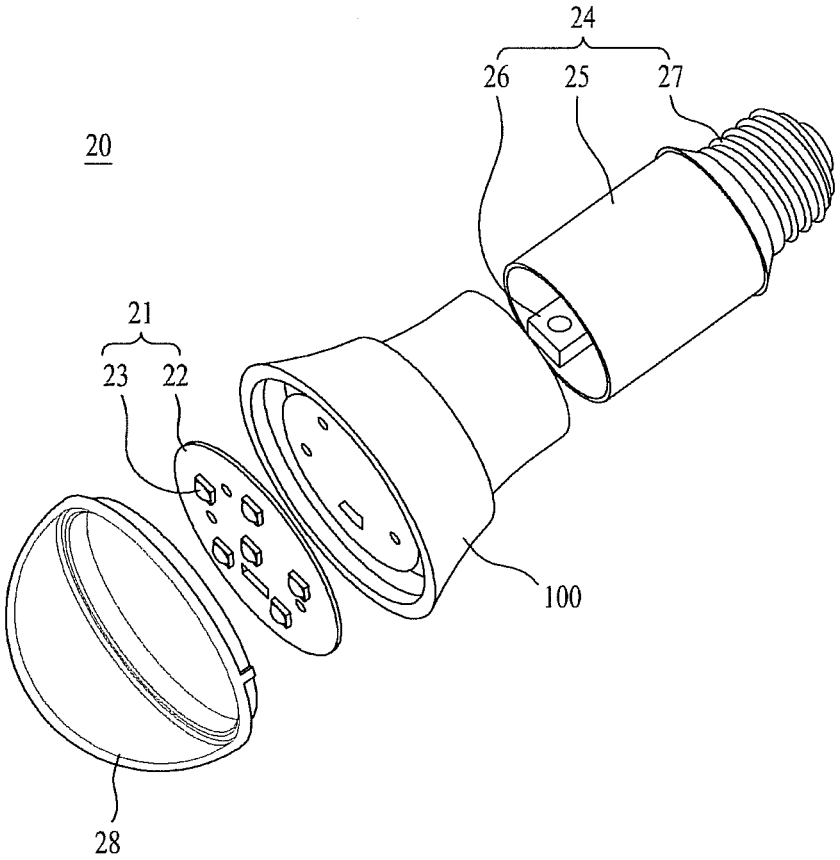
FIG. 3 is an exploded perspective view of a modular lighting apparatus corresponding to another product group according to the present disclosure.
Figure 4:
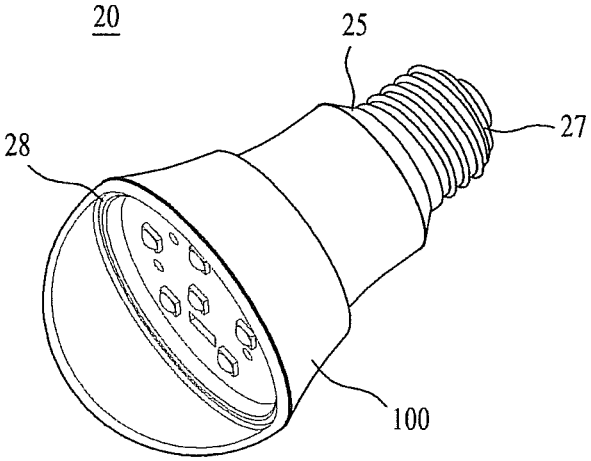
FIG. 4 is a perspective view showing an assembled state of modules shown in FIG. 3.

FIG. 3 is an exploded perspective view of a modular lighting apparatus 20 corresponding to another prescribed configuration according to the present disclosure, and FIG. 4 is a perspective view showing an assembled state of modules shown in FIG. 3. The modular lighting apparatus 20 may include the heat radiating module 100 having a predetermined volume, a light emitting module 21 which includes a substrate 22 mounted on the heat radiating module 100 and LEDs 23 arranged on the substrate 22, a power module 24 which includes a housing 25 mounted to the heat radiating module 100 and an electric unit 26 placed in the housing 25 to supply power to the light emitting module 21, and an optical module 28 which is configured to surround the light emitting module 21 and mounted to the heat radiating module 100.

Referring to FIGS. 3 and 4, the modular lighting apparatus 20 may be a bulb type. In this case, the optical module 28 may be a bulb (or globe). Moreover, a power socket may be provided to connect to an external power device. The power socket 27 may be referred to as an E-base.

Referring to FIGS. 1 to 4, the PAR type modular lighting apparatus 10 and the bulb type modular lighting apparatus 20 may each include the light emitting module 11, 21, the heat radiating module 100, the power module 14, 24, and the optical module 18, 28. In particular, the light emitting module 11, 21, the heat radiating module 100, and the power module 14, 24 may be commonly used, and only the optical modules 18 and 28 may be different. The respective modules may be engaged with each other via threads, may be hooked to each other via protrusions and recesses, or may be fastened to each other using, for example, screws or another appropriate method of coupling the components.

With regard to the lighting apparatuses 10 and 20 based on an E-base included in the power module, criteria for the shape thereof may be defined in ANSI C78.20 and C78.21. The criteria for the shape may include a volume of the heat radiating module 100, more particularly, a height and diameter of the heat radiating module 100. In addition, the criteria may include a diameter and height of the optical module 18, 28 as well as a diameter and height of the heat radiating module 100.

In addition, through selective combinations of the light emitting module, the heat radiating module, the power module, and the optical module, lighting apparatuses to satisfy ANSI standards established by a particular product group may be manufactured. These lighting apparatuses may be referred to as modular lighting apparatuses.

Figure 5:
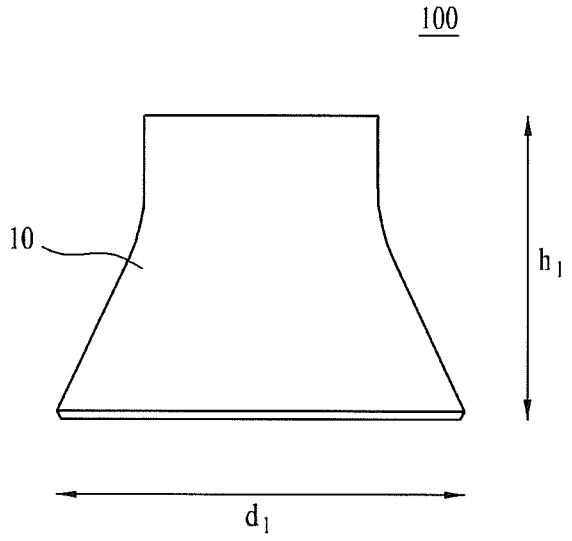
FIG. 5 is a front view showing a heat sink included in the modular lighting apparatus according to an embodiment of the present disclosure.
Figure 6A:
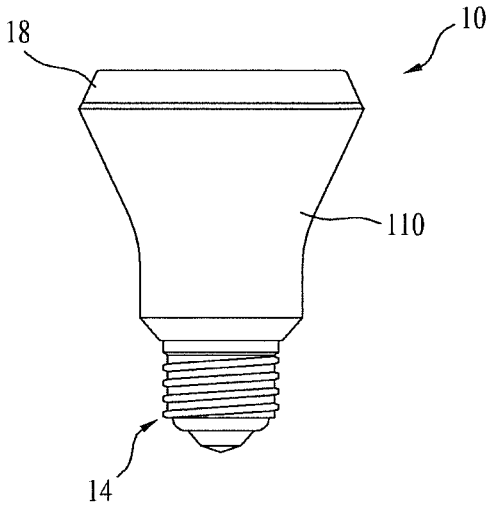
FIGS. 6A and 6B are front views showing the modular lighting apparatus to which the heat sink shown in FIG. 5 is applied.
Figure 6B:
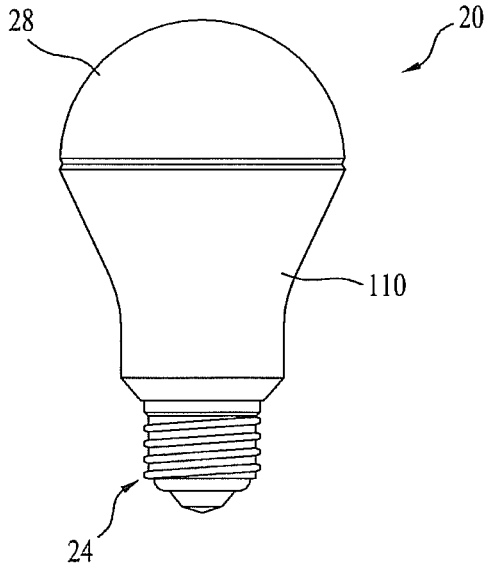

FIG. 5 is a front view showing a heat sink 110 included in the modular lighting apparatus according to an embodiment of the present disclosure, FIGS. 6A and 6B are front views showing the modular lighting apparatus to which the heat sink 110 shown in FIG. 5 is applied.

Referring to FIGS. 5, 6A and 6B, the modular lighting apparatus 10, 20 according to the embodiment of the present disclosure may include the heat radiating module 100 having a predetermined volume, the light emitting module 11, 21 which may include the substrate 12, 22 mounted on the heat radiating module 100 and the LEDs 13, 23 arranged on the substrate 12, 22, the power module 14, 24 which may include the housing 15, 25 mounted to the heat radiating module 100 and the electric unit 16, 26 placed in the housing 15, 25 to supply power to the light emitting module 11, 21, and the optical module 18, 28 which may be configured to surround the light emitting module 11, 21 and mounted to the heat radiating module 100.

Here, the heat radiating module 100 may include the heat sink 110, and at least one auxiliary heat sink (120, see FIG. 7) mounted to the heat sink 110 to vary a volume of the heat radiating module 100. In this case, the heat sink 110 may have a volume to satisfy standards established by a first product group. If the auxiliary heat sink 120 is coupled to the heat sink 110, the volume of the heat radiating module 100 may be changed to satisfy standards established by a second product group. Here, the standards may be ANSI standards or another appropriate type of standard.

In an embodiment, the heat sink 110 may satisfy ANSI standards established by at least one product group of ANSI A19, A21, P25, G30, PAR20, PAR30S, or R20. More specifically, the heat sink 110 may have a height h1 of about 48 mm and a diameter d1 of about 64.5 mm. In an embodiment, the heat sink 110 may have a minimum volume that may be equally applied to E26 and E27 product groups of ANSI standards. A diameter and height of the heat sink 110 may be determined to satisfy a particular product group. The heat radiating module 100 may vary in volume to satisfy standards established by other product groups via at least one auxiliary heat sink 120 as described above.

FIG. 6A shows a PAR type modular lighting apparatus to which the heat sink 110 shown in FIG. 5 is applied, and FIG. 6B shows a bulb type modular lighting apparatus to which the heat sink 110 shown in FIG. 5 is applied. Through provision of the heat sink 110, the PAR type modular lighting apparatus 10 may satisfy standards established by at least one product group of PAR20, PAR30S, or R20, and the bulb type modular lighting apparatus 20 may satisfy standards established by at least one product group of A10, A21, P25, or G30, for example.

Figure 7A:
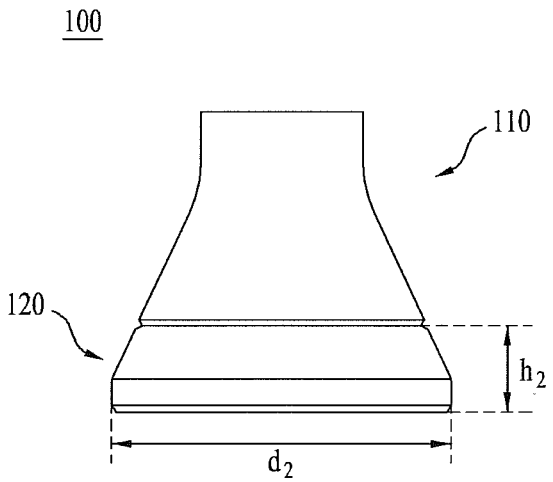
FIGS. 7A and 7B are views showing a first auxiliary heat sink included in a modular lighting apparatus according to an embodiment of the present disclosure.
Figure 7B:
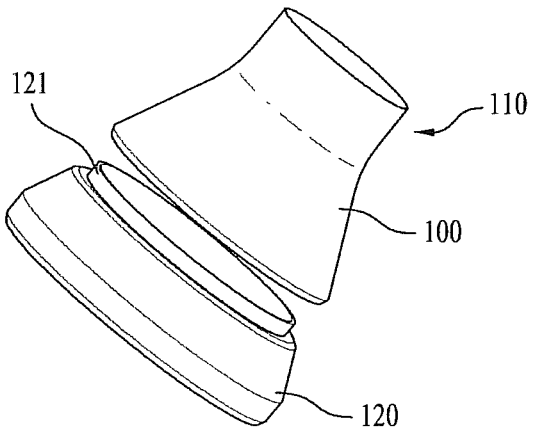
Figure 8A:
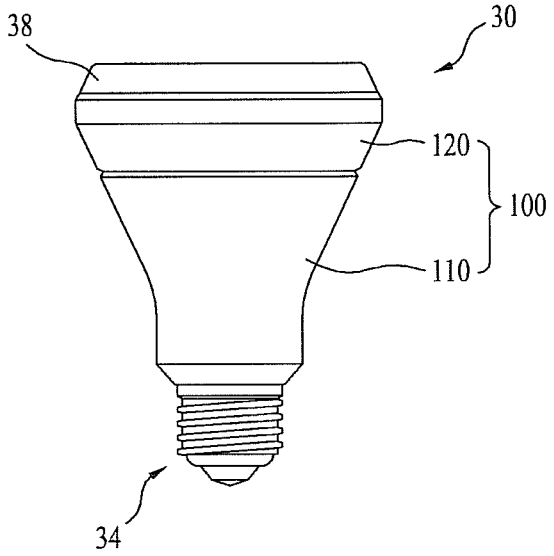
FIGS. 8A and 8B are front views showing the modular lighting apparatus to which the first auxiliary heat sink shown in FIGS. 8A and 8B is applied.
Figure 8B:
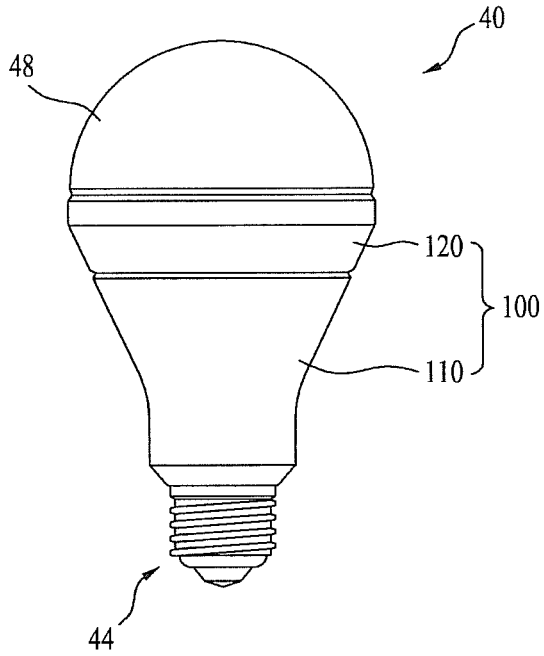

FIGS. 7A and 7B are views showing a first auxiliary heat sink included in a modular lighting apparatus according to an embodiment of the present disclosure, FIGS. 8A and 8B are front views showing the modular lighting apparatus to which the first auxiliary heat sink shown in FIG. 7 is applied.

Referring to FIGS. 7A, 7B, 8A and 8B, a modular lighting apparatus 30, 40 according to an embodiment of the present disclosure may include the heat radiating module 100 having a predetermined volume, a light emitting module which may include a substrate mounted on the heat radiating module 100 and LEDs arranged on the substrate, a power module 34, 44 which may include a housing mounted to the heat radiating module 100 and an electric unit placed in the housing to supply power to the light emitting module, and an optical module 38, 48 which may be configured to surround the light emitting module and mounted to the heat radiating module 100.

Here, the heat radiating module 100 may include the heat sink 110, and the at least one auxiliary heat sink 120 coupled to the heat sink 110 to vary a volume of the heat radiating module 100. The auxiliary heat sink 120 may function to increase a volume of the heat radiating module 100 to which the heat sink 110 has been mounted. More specifically, the auxiliary heat sink 120 may increase a height and diameter of the heat radiating module 100.

In this case, the heat sink 110 may have a volume to satisfy standards established by a first product group. If the auxiliary heat sink 120 is coupled to the heat sink 110, the volume of the heat radiating module 100 may be changed to satisfy standards established by a second product group. Here, the standards may be ANSI standards or another appropriate type of standard.

More specifically, if the modular lighting apparatus, to which only the heat sink 110 is applied, has a volume to satisfy ANSI standards established by a first product group, the modular lighting apparatus, to which the auxiliary heat sink 120 as well as the heat sink 110 are applied, may have a volume to satisfy ANSI standards established by a second product group.

In an embodiment, the heat sink 110 may satisfy standards established by at least one product group of ANSI A19, A21, P25, G30, PAR20, PAR30S, or R20. More specifically, the heat sink 110 may have a height h1 of about 48 mm and a diameter d1 of about 64.5 mm. A diameter and height of the heat sink 110 may be determined to correspond to a particular product group. The heat radiating module 100 may vary in volume to satisfy standards established by other product groups via at least one auxiliary heat sink 120 as described above. In an embodiment, the heat sink 110 may have a minimum volume that may be equally applied to E26 and E27 product groups of ANSI standards. The auxiliary heat sink 120 may have a height h2 of about 23.7 mm and a diameter d2 of about 77.2 mm.

In an embodiment, if the auxiliary heat sink 120 is coupled to the heat sink 110, the heat radiating module 100 may satisfy standards established by at least one product group of A23, PAR30L, BR30, PAR38, or BRL38. If the auxiliary heat sink 120 has a greater height and diameter, the heat radiating module 100 may satisfy standards established by at least one product group of ER40, BR40, R40, PS25, or PS30. More specifically, coupling the auxiliary heat sink 120 to the heat sink 110 enables construction of the heat radiating module 100 that satisfies standards established by other products groups.

Here, the auxiliary heat sink 120 may be separably coupled to the heat sink 110. In an embodiment, the heat sink 110 may have first helix, and the auxiliary heat sink 120 may have second helix 121 to be helically engaged with the first helix.

As described above, a diameter of the auxiliary heat sink 120 may be greater than a diameter of the heat sink 110, and a height of the auxiliary heat sink 120 may be less than a height of the heat sink 110. The auxiliary heat sink 120 may be located between the heat sink 110 and the optical module 38, 48, or may be located between the heat sink 110 and the power module 34, 44. In an embodiment, if the auxiliary heat sink 120 is coupled to the heat sink 110, the light emitting module and the optical module 38, 48 may be mounted to the auxiliary heat sink 120.

As described above, the modular lighting apparatus 30, 40 according to the embodiment of the present disclosure may easily vary a volume of the heat radiating module 100 to satisfy standards established by a variety of product groups, and may achieve enhanced assembly efficiency via a few modules that may be designed for common use.

Further, according to the present disclosure, the heat sink 110 having a minimum volume that may be equally applied to various product groups of ANSI standards is provided, and the auxiliary heat sink 120 may be coupled to the heat sink 110 to increase a volume of the heat radiating module 100. In this way, the resulting heat radiating module may satisfy standards established by various product groups.

Furthermore, according to the present disclosure, the light emitting module, the heat radiating module, the power module, and the optical module may be fastened to one another via, for example, screws, or may be fitted into one another, for example, by friction fitting, connection tabs, hooks and notches, or the like. This may result in enhanced assembly convenience. In addition, according to the present disclosure, the auxiliary heat sink to vary a volume of the heat radiating module may be separably coupled to the heat sink, which may result in enhanced assembly convenience.

FIG. 8A shows the PAR type modular lighting apparatus 30 to which the heat radiating module 100 shown in FIG. 7 is applied, and FIG. 8B shows the bulb type modular lighting apparatus 40 to which the heat radiating module 100 shown in FIG. 7 is applied. Through provision of the heat sink 110 and the auxiliary heat sink 120, the PAR type modular lighting apparatus 30 may satisfy standards established by at least one product group of PAR30L, BR30, PAR38, or BRL38, and the bulb type modular lighting apparatus 40 may satisfy standards established by an A23 product group, for example.

Figure 9A:
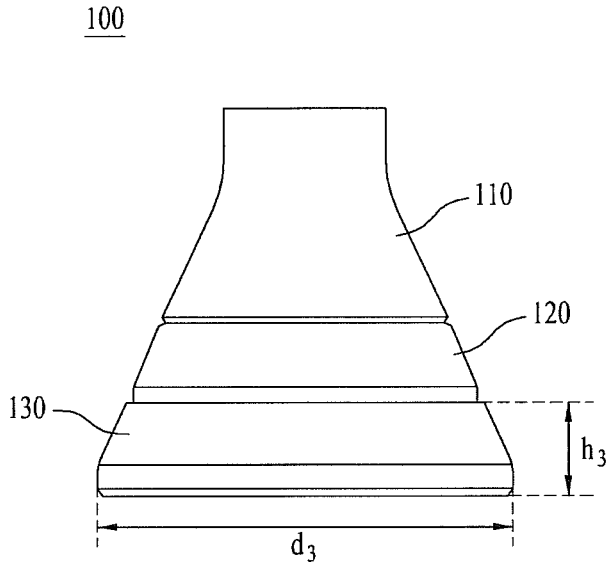
FIGS. 9A and 9B are views showing a second auxiliary heat sink included in the modular lighting apparatus according to an embodiment of the present disclosure.
Figure 9B:
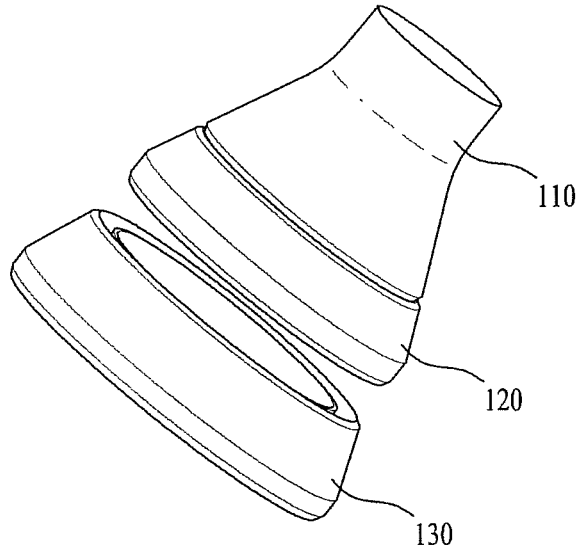
Figure 10A:
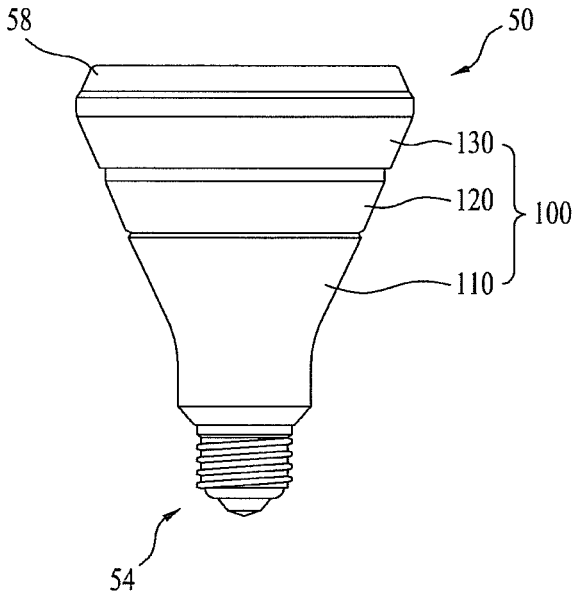
FIGS. 10A and 10B are front views showing the modular lighting apparatus to which the second auxiliary heat sink shown in FIGS. 9A and 9B is applied.
Figure 10B:
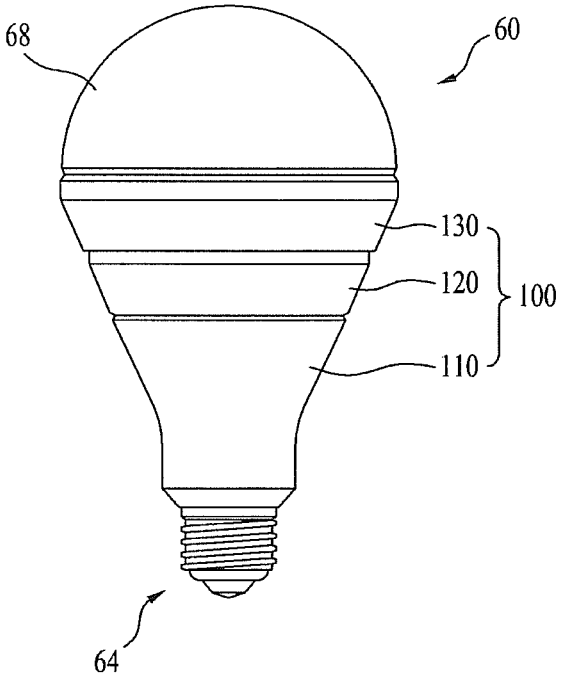

FIGS. 9A and 9B are views showing a second auxiliary heat sink included in the modular lighting apparatus according to an embodiment of the present disclosure. FIGS. 10A and 10B are front views showing the modular lighting apparatus to which the second auxiliary heat sink shown in FIG. 9 is applied. Referring to FIGS. 9 and 10, a modular lighting apparatus 50, 60 according to an embodiment of the present disclosure includes the heat radiating module 100 having a predetermined volume, a light emitting module (not shown, see FIGS. 1 and 3) which may include a substrate mounted on the heat radiating module 100 and LEDs arranged on the substrate, a power module 54, 64 which may include a housing mounted to the heat radiating module 100 and an electric unit placed in the housing to supply power to the light emitting module, and an optical module 58, 68 which may be configured to surround the light emitting module and mounted to the heat radiating module 100.

Here, the heat radiating module 100 may include the heat sink 110, and one or more auxiliary heat sinks 120 and 130 coupled to the heat sink 110 to vary a volume of the heat radiating module 100. The heat radiating module 100 may include the heat sink 110, the first auxiliary heat sink 120 coupled to the heat sink 110 to vary a volume of the heat radiating module 100, and the second auxiliary heat sink 130 coupled to the first auxiliary heat sink 120 to vary a volume of the heat radiating module 100.

In this case, the heat sink 110 may have a volume to satisfy standards established by a first product group. If the first auxiliary heat sink 120 is coupled to the heat sink 110, the heat radiating module 100 may vary in volume to satisfy standards established by a second product group. In addition, if the first auxiliary heat sink 120 is coupled to the heat sink 110 and in turn, the second auxiliary heat sink 130 is coupled to the first auxiliary heat sink 120, the volume of the heat radiating module 100 may further be varied to satisfy standards established by a third product group. Here, the standards may be ANSI standards or another appropriate type of standard as described above.

In an embodiment, the heat sink 110 may satisfy standards established by at least one product group of ANSI A19, A21, P25, G30, PAR20, PAR30S, or R20. More specifically, the heat sink 110 may have a height h1 of about 48 mm and a diameter d1 of about 64.5 mm.

A diameter and height of the heat sink 110 may be determined to satisfy standards established by a particular product group. The heat radiating module 100 may vary in volume to satisfy standards established by other product groups via one or more auxiliary heat sinks 120 and 130 as described above.

The first auxiliary heat sink 120 may have a height h2 of about 23.7 mm and a diameter d2 of about 77.2 mm. The first auxiliary heat sink 120 is similar to the auxiliary heat sink 120 as described above with reference to FIGS. 7A and 7B. The second auxiliary heat sink 130 may have a height h3 of about 20.2 mm and a diameter d3 of about 93 mm.

In an embodiment, if the first auxiliary heat sink 120 is coupled to the heat sink 110, the heat radiating module 100 may satisfy standards established by at least one product group of A23, PAR30L, BR30, PAR38, or BRL38. If the second auxiliary heat sink 130 is coupled to the first auxiliary heat sink 120, the heat radiating module 100 may satisfy standards established by at least one product group of ER40, BR40, R40, PS25, or PS30, for example.

More specifically, as the first and second auxiliary heat sinks 120 and 130 are selectively mounted to the heat sink 110, the heat radiating module 100 to satisfy standards established by other product groups may be constructed. Here, the first auxiliary heat sink 120 may be separably coupled to the heat sink 110, and the second auxiliary heat sink 130 may be separably coupled to the first auxiliary heat sink 120.

In an embodiment, the heat sink 110 may have first helix, and the first auxiliary heat sink 120 may have second helix 121 to be helically engaged with the first helical threads. Likewise, the second auxiliary heat sink 131 may have helix, thus being separably coupled to the second auxiliary heat sink 120.

As described above, a diameter of the first auxiliary heat sink 120 may be greater than a diameter of the heat sink 110, and a height of the first auxiliary heat sink 120 may be less than a height of the heat sink 110. Likewise, a diameter of the second auxiliary heat sink 130 may be greater than a diameter of the first auxiliary heat sink 120, and a height of the second auxiliary heat sink 130 may be less than a height of the first auxiliary heat sink 110. It should be appreciated, however, that the present disclosure is not limited thereto, and the shape and size of each section of the heat radiating module 100 may be formed to conform to prescribed specifications of multiple desired standards.

If the first auxiliary heat sink 120 is coupled to the heat sink 110, the light emitting module and the optical module may be mounted to the first auxiliary heat sink 120. If the first auxiliary heat sink 120 is coupled to the heat sink 110 and in turn, the second auxiliary heat sink 130 is coupled to the first auxiliary heat sink 120, the light emitting unit and the optical module may be mounted to the second auxiliary heat sink 130.

FIG. 10A shows the PAR type modular lighting apparatus 50 to which the heat radiating module 100 shown in FIGS. 9A and 9B is applied, and FIG. 10B shows the bulb type modular lighting apparatus 60 to which the heat radiating module 100 shown in FIGS. 9A and 9B is applied. Through provision of the heat sink 110, the first auxiliary heat sink 120, and the second auxiliary heat sink 130, the PAR type modular lighting apparatus 50 may satisfy standards established by at least one product group of R40, BR40, or R40, and the bulb type modular lighting apparatus 60 may satisfy standards established by at least one product group of PS25 or PS30, for example.

Hereinafter, a method of manufacturing the modular lighting apparatus having the above-described configuration will be described in detail.

The method of manufacturing the modular lighting apparatus according to an embodiment of the present disclosure may be a method of manufacturing a modular lighting apparatus that includes a heat radiating module that includes a heat sink having a first height, a first auxiliary heat sink having a second height, the first auxiliary heat sink being coupled to the heat sink, and a second auxiliary heat sink having a third height, the second auxiliary heat sink being coupled to the first auxiliary heat sink, a light emitting module, a power module, and an optical module.

More specifically, the method of manufacturing the modular lighting apparatus according to an embodiment of the present disclosure may be a method of manufacturing a modular lighting apparatus that includes a heat radiating module that includes a heat sink having a first height, a first auxiliary heat sink having a second height, the first auxiliary heat sink being coupled to the heat sink, and a second auxiliary heat sink having a third height, the second auxiliary heat sink being coupled to the first auxiliary heat sink, a light emitting module that may include a substrate mounted on the heat radiating module and LEDs arranged on the substrate, a power module that may include a housing mounted to the heat radiating module and an electric unit placed in the housing to supply power to the light emitting module, and an optical module that may be selected according to beam angle, height and diameter conditions.

According to the method of manufacturing the modular lighting apparatus, a modular lighting apparatus to satisfy standards established by a first product group may be manufactured via assembly of the heat sink, the light emitting module, the power module, and the optical module. A modular lighting apparatus to satisfy standards established by a second product group is manufactured via assembly of the heat sink, the first auxiliary heat sink, the light emitting module, the power module, and the optical module. Moreover, a modular lighting apparatus to satisfy standards established by a third product group is manufactured via assembly of the heat sink, the first auxiliary heat sink, the second auxiliary heat sink, the light emitting module, the power module, and the optical module. Here, all of the aforementioned modular lighting apparatuses to satisfy standards established by the first to third product groups may include the heat radiating module, the optical module, the light emitting module, and the power module.

It is noted that the modular lighting apparatus to satisfy standards established by the first product group may employ the heat radiating module that includes the heat sink, the modular lighting apparatus to satisfy standards established by the second product group may employ the heat radiating module that includes the heat sink and the first auxiliary heat sink, and the modular lighting apparatus to satisfy standards established by the third product group may employ the heat radiating module that includes the heat sink, the first auxiliary heat sink, and the second auxiliary heat sink. In addition, as described above, the first auxiliary heat sink may be separably coupled to the heat sink, and the second auxiliary heat sink may be separably coupled to the first auxiliary heat sink.

As described above, the standards may include ANSI C78.20 and C78.21, and the sum of the first height, the second height, and the third height may be within a range of 85 mm to 95 mm. In an embodiment, the sum of the first height, the second height, and the third height may be about 91.9 mm. As described above, it is to be understood that the first height, the second height, the third height, and the sum thereof may be determined in various ways according to product groups to be desired.

More specifically, in this case, if the heat sink has a volume to satisfy standards established by a first product group and the first auxiliary heat sink is coupled to the heat sink, the heat radiating module may vary in volume to satisfy standards established by a second product group. In addition, if the first auxiliary heat sink is coupled to the heat sink and in turn, the second auxiliary heat sink is coupled to the first auxiliary heat sink, the heat radiating module may vary in volume to satisfy standards established by a third product group. As described above, the standards may be ANSI standards or another appropriate type of standard.

That is, if the modular lighting apparatus, to which only the heat sink is applied, has a volume to satisfy ANSI standards established by a first product group, the modular lighting apparatus, to which the auxiliary heat sink as well as the heat sink are applied, has a volume to satisfy ANSI standards established by a second product group. In addition, if the first auxiliary heat sink is coupled to the heat sink and in turn, the second auxiliary heat sink is coupled to the first auxiliary heat sink, the heat radiating module has a volume to satisfy ANSI standards established by a third product group.

As described above, as the first and second auxiliary heat sinks are selectively mounted to the heat sink, the heat radiating module to satisfy standards established by other product groups may be constructed. Here, the first auxiliary heat sink may be separably coupled to the heat sink, and the second auxiliary heat sink may be separably coupled to the first auxiliary heat sink.

In an embodiment, the heat sink may have first helix, and the first auxiliary heat sink may have second helix to be helically engaged with the first helix. Likewise, the second auxiliary heat sink may have helix, thus being separably coupled to the second auxiliary heat sink.

As described above, a diameter of the first auxiliary heat sink may be greater than a diameter of the heat sink, and a height of the first auxiliary heat sink may be less than a height of the heat sink. Likewise, a diameter of the second auxiliary heat sink may be greater than a diameter of the first auxiliary heat sink, and a height of the second auxiliary heat sink may be less than a height of the first auxiliary heat sink. Moreover, the prescribed size and shape of each section of the modular lighting apparatus may be formed to correspond to specifications of a desired standard.

If the first auxiliary heat sink is coupled to the heat sink, the light emitting module and the optical module may be mounted to the first auxiliary heat sink. If the first auxiliary heat sink is coupled to the heat sink and in turn, the second auxiliary heat sink is coupled to the first auxiliary heat sink, the light emitting unit and the optical module may be mounted to the second auxiliary heat sink.

Referring to FIG. 5, the first height h1 of the heat sink 110 may be within a range of 45 mm to 50 mm. In an embodiment, the first height h1 may be about 48 mm, and the maximum diameter d1 of the heat sink 110 may be about 46.5 mm. Referring to FIG. 7, the modular lighting apparatus to satisfy standards established by the first product group may satisfy standards established by at least one product group of A19, A21, P25, G30, PAR20, PAR30S, or R20, for example.

In addition, referring to FIG. 7, the second height h2 of the first auxiliary heat sink 120 may be within a range of 20 mm to 25 mm. In an embodiment, the second height h2 may be about 23.7 mm, and the maximum diameter d2 of the first auxiliary heat sink 120 may be about 77.2 mm. The modular lighting apparatus to satisfy standards established by the second product group may satisfy standards established by at least one product group of A23, PAR30L, BR30, PAR38, or BRL38, for example.

Referring to FIGS. 9A and 9B, the third height h3 of the second auxiliary heat sink 130 may be within a range of 18 mm to 22 mm. In an embodiment, the third height h3 may be about 20.2 mm, and the maximum diameter d3 of the second auxiliary heat sink 130 may be about 93 mm. The modular lighting apparatus to satisfy standards established by the third product group may satisfy standards established by at least one product group of ER40, BR40, R40, PS25, or PS30, for example. Moreover, an auxiliary heat sink may be provided that corresponds to a size and shape of the combination of the first and second auxiliary heat sinks 120, 130 to satisfy, for example, the specifications of the third product group.

The above-described standards may be arranged as in the following table.

TABLE 1

| Object | Height of Heat Sink | Height of First Auxiliary Heat Sink | Height of Second Auxiliary Heat Sink | Height of Heat Radiating Module |
|---|---|---|---|---|
| First Product Group | 48 mm | | | 48 mm |
| Second Product Group | 48 mm | 23.7 mm | | 71.7 mm |
| Third Product Group | 48 mm | 23.7 mm | 20.2 mm | 91.9 mm |

The modular lighting apparatus may be determined as a bulb type or PAR type product group of ANSI standards according to a beam angle and shape of the optical module. The modular lighting apparatus may satisfy ANSI standards established by various other product groups according to a height and diameter of the optical module.

As is apparent from the above description, according to a modular lighting apparatus and a method of manufacturing the same according to an embodiment of the present disclosure, it is possible to easily vary a volume of a heat radiating module to satisfy standards established by a variety of product groups.

Further, according to a modular lighting apparatus and a method of manufacturing the same according to an embodiment of the present disclosure, it is possible to achieve enhanced assembly efficiency via a few modules that may be designed for common use.

Furthermore, according to a modular lighting apparatus and a method of manufacturing the same according to an embodiment of the present disclosure, it is possible to satisfy standards established by a plurality of product groups via utilization of a few modules.

In addition, according to a modular lighting apparatus and a method of manufacturing the same according to an embodiment of the present disclosure, it is possible to achieve reduced manufacturing costs and simplified manufacturing facilities and to enable mass production with a small number of facilities.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

As embodied and broadly described herein, a manufacturing method of a modular lighting apparatus is provided. The modular lighting apparatus may include a heat radiating module which includes a heat sink having a first height, a first auxiliary heat sink having a second height, the first auxiliary heat sink being coupled to the heat sink, and a second auxiliary heat sink having a third height, the second auxiliary heat sink being coupled to the first auxiliary heat sink, a light emitting module which includes a substrate mounted on the heat radiating module and Light Emitting Diodes (LEDs) arranged on the substrate, a power module which includes a housing mounted to the heat radiating module and an electric unit placed in the housing to supply power to the light emitting module, and an optical module which may be selected according to beam angle, height and diameter conditions. A modular lighting apparatus of standards established by a first product group may be manufactured via assembly of the heat sink, the light emitting module, the power module, and the optical module. A modular lighting apparatus of standards established by a second product group may be manufactured via assembly of the heat sink, the first auxiliary heat sink, the light emitting module, the power module, and the optical module. Here, a modular lighting apparatus of standards established by a third product group may be manufactured via assembly of the heat sink, the first auxiliary heat sink, the second auxiliary heat sink, the light emitting module, the power module, and the optical module.

The standards may include American National Standards Institute (ANSI) C78.20 and C78.21, and the sum of the first height, the second height, and the third height may be within a range of 85 mm to 95 mm. The first height may be within a range of 45 mm to 50 mm, and the modular lighting apparatus of standards established by the first product group may satisfy standards established by at least one product group of A19, A21, P25, G30, PAR20, PAR30S, or R20. The second height may be within a range of 20 mm to 25 mm, and the modular lighting apparatus of standards established by the second product group may satisfy standards established by at least one product group of A23, PAR30L, BR30, PAR38, or BRL38. Moreover, the third height may be within a range of 18 mm to 22 mm, and the modular lighting apparatus of standards established by the third product group may satisfy standards established by at least one product group of ER40, BR40, R40, PS25, or PS30.

The modular lighting apparatus may be determined as a bulb type or Parabolic Aluminized Reflector (PAR) type product group of ANSI standards according to a beam angle and shape of the optical module, and the modular lighting apparatus may satisfy ANSI standards established by different product groups according to a height and diameter of the optical module.

In accordance with another aspect of the present disclosure, a modular lighting apparatus may include a heat radiating module having a predetermined volume, a light emitting module which includes a substrate mounted on the heat radiating module and LEDs arranged on the substrate, a power module which includes a housing mounted to the heat radiating module and an electric unit placed in the housing to supply power to the light emitting module, and an optical module which is configured to surround the light emitting module and mounted to the heat radiating module.

Here, the heat radiating module may include a heat sink, and at least one auxiliary heat sink coupled to the heat sink to vary a volume of the heat radiating module. The heat sink may have a volume to satisfy ANSI standards established by a first product group, and the heat radiating module varies in volume to satisfy ANSI standards established by a second product group if the auxiliary heat sink is coupled to the heat sink.

The auxiliary heat sink may be separably coupled to the heat sink. The heat sink may have first helix, and the auxiliary heat sink may have second helix to be helically engaged with the first helix. Moreover, a diameter of the auxiliary heat sink may be greater than a diameter of the heat sink, and a height of the auxiliary heat sink may be less than a height of the heat sink.

In accordance with a further aspect of the present disclosure, a modular lighting apparatus may include a heat radiating module having a predetermined volume, a light emitting module which includes a substrate mounted on the heat radiating module and LEDs arranged on the substrate, a power module which includes a housing mounted to the heat radiating module and an electric unit placed in the housing to supply power to the light emitting module, and an optical module which is configured to surround the light emitting module and mounted to the heat radiating module. The heat radiating module may include a heat sink, and at least one auxiliary heat sink coupled to the heat sink to vary a volume of the heat radiating module, and wherein the optical module includes a lens unit or bulb having different beam angles, height, and diameters.

The heat sink may have a volume to satisfy ANSI standards established by a first product group, and the heat radiating module may vary in volume to satisfy ANSI standards established by a second product group if the auxiliary heat sink is coupled to the heat sink.

The modular lighting apparatus may be determined as a bulb type or PAR type product group of ANSI standards according to a beam angle and shape of the optical module, and the modular lighting apparatus may satisfy ANSI standards established by different product groups according to a height and diameter of the optical module.

In one embodiment, a modular lighting apparatus may include a heat radiating module having a prescribed volume, a light emitting module that includes a substrate provided on the heat radiating module and at least one LED provided on the substrate, a power module that includes a housing coupled to the heat radiating module and an electric unit provided in the housing to supply power to the light emitting module, and an optical module coupled to the heat radiating module and provided to surround the light emitting module. The heat radiating module may include a heat sink having a first prescribed volume and at least one auxiliary heat sink having a second prescribed volume, the at least one auxiliary heat sink being coupled to the heat sink to vary the prescribed volume of the heat radiating module. The first prescribed volume of the heat sink may conform to a first ANSI standard. The second prescribed volume of the at least one auxiliary heat sink may change the prescribed volume of the heat radiating module to conform to a second ANSI standard when the auxiliary heat sink is coupled to the heat sink.

The heat sink may conform to standards for groups of at least one of A19, A21, P25, G30, PAR20, PAR30S, or R20. The heat radiating module may conform to standards for product groups of at least one of A23, PAR30L, BR30, PAR38, BRL38, ER40, BR40, R40, PS25, or PS30 when the auxiliary heat sink is coupled to the heat sink.

The at least one auxiliary heat sink may include a first auxiliary heat sink and a second auxiliary heat sink coupled to the first auxiliary heat sink and the second auxiliary heat sink may have a greater diameter than the first auxiliary heat sink. The light emitting module and the optical module may be mounted to the first auxiliary heat sink when the first auxiliary heat sink is coupled to the heat sink. The light emitting module and the optical module may be mounted to the second auxiliary heat sink when the first auxiliary heat sink is coupled to the heat sink and the second auxiliary heat sink is coupled to the first auxiliary heat sink.

The heat radiating module may conform to standards for product groups of at least one of A23, PAR30L, BR30, PAR38, or BRL38. The heat radiating module may conform to standards for product groups of at least one of ER40, BR40, R40, PS25, or PS30 when the first auxiliary heat sink is coupled to the heat sink and the second auxiliary heat sink is coupled to the first auxiliary heat sink.

The auxiliary heat sink may be separably coupled to the heat sink. The heat sink may have first helix and the auxiliary heat sink may have a second helix that corresponds to the first helix to be engaged with the first helix.

A diameter of the auxiliary heat sink may be greater than a diameter of the heat sink and a height of the auxiliary heat sink is less than a height of the heat sink and the power module. The light emitting module and the optical module may be provided on the auxiliary heat sink when the auxiliary heat sink is coupled to the heat sink.

In another embodiment, a modular lighting apparatus may include a heat radiating module that has a prescribed volume, a light emitting module that includes a substrate mounted on the heat radiating module and at least one LED provided on the substrate, a power module that includes a housing coupled to the heat radiating module and an electric unit provided in the housing to supply power to the light emitting module, and an optical module coupled to the heat radiating module and provided to surround the light emitting module. The heat radiating module may include a first heat sink and a second heat sink coupled to the first heat sink to change a volume of the heat radiating module. The optical module may include a lens assembly or a bulb that has different light emission patterns, height and diameter, and the heat sink may be configured to interchangeably couple with the optical module that includes the lens assembly or the optical module that includes the bulb.

The modular lighting apparatus may be a bulb type or a Parabolic Aluminized Reflector (PAR) type lighting apparatus that conforms to ANSI standards based on a light emission pattern and a shape of the optical module. The modular lighting apparatus may conform to different ANSI standards based on a height and diameter of the optical module.

In one embodiment, a method of manufacturing a modular lighting apparatus may include configuring a heat radiating module to have a prescribed configuration that conforms to a prescribed standard, assembling a light emitting module to a heat radiating module, the light emitting module that includes a substrate provided on the heat radiating module and at least one LED arranged on the substrate, coupling a power module to the light emitting module, the light emitting module that includes a housing coupled to the heat radiating module and an electric unit provided in the housing to supply power to the light emitting module, and assembling an optical module to the heat radiating module, the optical module having a prescribed light emission pattern, height and diameter. Configuring the heat radiating module may include when the modular lighting apparatus is configured according to a first standard associated with a first product group, providing a first heat sink having a first height for assembly with the light emitting module, when the modular lighting apparatus is configured according to a second standard associated with a second product group, assembling a second heat sink having a second prescribed height to the first heat sink, and when the modular lighting apparatus is configured according to a third standard associated with a third product group, assembling a third heat sink having a third prescribed height to the second heat sink and the first heat sink.

The standards may include American National Standards Institute (ANSI) C78.20 and C78.21 and the sum of the first height, the second height, and the third height may be within a range of 85 mm to 95 mm. The first height may be within a range of 45 mm to 50 mm and the modular lighting apparatus configured according to the first standard may conform to standards for product groups of at least one of A19, A21, P25, G30, PAR20, PAR30S, or R20. The second height may be within a range of 20 mm to 25 mm and the modular lighting apparatus configured according to the second standard may conform to standards for product groups of at least one of A23, PAR30L, BR30, PAR38, or BRL38. The third height may be within a range of 18 mm to 22 mm and the modular lighting apparatus configured according to the third height may conform to standards for product groups of at least one of ER40, BR40, R40, PS25, or PS30.

The modular lighting apparatus may be a bulb type or a Parabolic Aluminized Reflector (PAR) type that conforms to ANSI standards based on a light emission angle and a shape of the optical module. A height and a diameter of the optical module may be selected to conform to an ANSI standard corresponding to a prescribed product group.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

For instance, a modular lighting apparatus, which may vary a volume of a heat radiating module via at least one auxiliary heat sink to satisfy standards established by a particular product group, has been described heretofore, but the present disclosure is not limited thereto. For example, modular components may be configured to provide flexibility in meeting other specifications such as light distribution, heat, or another type of specification.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A modular lighting apparatus comprising:

a heat radiating module having a prescribed volume;

a light emitting module that includes a substrate provided on the heat radiating module and at least one LED provided on the substrate;

a power module that includes a housing coupled to the heat radiating module and an electric unit provided in the housing to supply power to the light emitting module; and an optical module coupled to the heat radiating module and provided to surround the light emitting module, wherein the heat radiating module includes a heat sink having a first prescribed volume, and an auxiliary heat sink having a second prescribed volume, the auxiliary heat sink being coupled to the heat sink to vary the prescribed volume of the heat radiating module, wherein the first prescribed volume of the heat sink conforms to a first ANSI standard, wherein the second prescribed volume of the auxiliary heat sink changes the prescribed volume of the heat radiating module to conform to a second ANSI standard when the auxiliary heat sink is coupled to the heat sink, the first and second ANSI standards being different from each other, wherein the auxiliary heat sink includes a first auxiliary heat sink removably coupled to the heat sink and a second auxiliary heat sink removably coupled to the first auxiliary heat sink, the second auxiliary heat sink having a greater diameter than the first auxiliary heat sink, and wherein the first auxiliary heat sink and the second auxiliary heat sink are configured such that the light emitting module and the optical module are directly mounted to the second auxiliary heat sink when both the first auxiliary heat sink and the second auxiliary heat sink are used in the modular lighting apparatus and the light emitting module and the optical module are directly mounted to the first auxiliary heat sink when the first auxiliary heat sink is used while the second auxiliary heat sink is not used in the modular lighting apparatus.

2. The apparatus according to claim 1, wherein a shape and volume of the heat radiating module conforms to standards for product groups of at least one of A23, PAR30L, BR30, PAR38, BRL 38, ER40, BR40, R40, PS25, or PS30 based on a configuration of the auxiliary heat sink coupled to the heat sink.

3. The apparatus according to claim 2, wherein the shape and volume of the heat radiating module conforms to standards for product groups of at least one of A23, PAR30L, BR30, PAR38, or BRL 38 when the first auxiliary heat sink is coupled to the heat sink while the second auxiliary heat sink is not used.

4. The apparatus according to claim 3, wherein the shape and volume of the heat radiating module conforms to standards for product groups of at least one of ER40, BR40, R40, PS25, or PS30 when the first auxiliary heat sink is coupled to the heat sink and the second auxiliary heat sink is coupled to the first auxiliary heat sink.

5. The apparatus according to claim 1, wherein the auxiliary heat sink is separably coupled to the heat sink.

6. The apparatus according to claim 5, wherein the heat sink has a first helix, and the auxiliary heat sink has a second helix that corresponds to the first helix to be engaged with the first helix.

7. The apparatus according to claim 1, wherein the heat sink has a height within a range of 45 mm to 50 mm, the first auxiliary heat sink has a height within a range of 20 mm to 25 mm, and the second auxiliary heat sink has a height in the range of 18 mm to 22 mm.

8. The apparatus according to claim 7, wherein a diameter of the heat sink is about 64.5 mm, a diameter of the first auxiliary heat sink is about 77.2 mm, and a diameter of the second auxiliary heat sink is about 93 mm.

9. The apparatus according to claim 1, wherein a shape and the volume of the heat sink conforms to standards for product groups of at least one of A19, A21, P25, G30, PAR20, PAR30S, or R20.

10. The apparatus according to claim 1, wherein a diameter of the auxiliary heat sink is greater than a diameter of the heat sink, and wherein a height of the auxiliary heat sink is less than a height of the heat sink.

11. A modular lighting apparatus comprising:

a heat radiating module having a prescribed volume;

a light emitting module that includes a substrate mounted on the heat radiating module and at least one LED provided on the substrate;

a power module that includes a housing coupled to the heat radiating module and an electric unit provided in the housing to supply power to the light emitting module; and an optical module coupled to the heat radiating module and provided to surround the light emitting module, the optical module having a lens assembly or a bulb that have different light emission patterns, height, and diameter, wherein the heat radiating module includes a first heat sink, a second heat sink configured to be coupled to the first heat sink, and a third heat sink configured to be coupled to the second heat sink, a configuration of the heat radiating module being changed using the first, second, and third heat sinks in order to change a volume of the heat radiating wherein the optical module includes a lens assembly or a bulb that have different light module, wherein the first heat sink has a first volume that conforms to a first ANSI standard associated with a first product group, the second heat sink has a second volume, and the third heat sink has a third volume, each of the first, second, and third heat sinks having a different volume, wherein, when the second heat sink is coupled to the first heat sink, the prescribed volume of the heat radiating module is changed to a second prescribed volume that conforms to a second ANSI standard associated with a second product group, and when the third heat sink is coupled to the first and second heat sinks, the prescribed volume of the heat radiating module is changed to a third prescribed volume that conforms to a third ANSI standard associated with a third product group, wherein the first, second and third ANSI standards are different from each other, and wherein a height of the first heat sink is about 48 mm and a diameter of the first heat sink is about 64.5 mm, a height of the second heat sink configured to be coupled to the first heat sink is about 23.7 mm and a diameter of the second heat sink is about 77.2 mm, and a height of the third heat sink configured to be coupled to the second heat sink is about 20.2 mm and a diameter of the third heat sink is about 93 mm.

12. The apparatus according to claim 11, wherein the modular lighting apparatus is a bulb type or a Parabolic Aluminized Reflector (PAR) type lighting apparatus that conforms to ANSI standards based on a light emission pattern and a shape of the optical module, and wherein the modular lighting apparatus conforms to different ANSI standards based on a height and diameter of the optical module.

13. The apparatus according to claim 11, wherein the first, second, and third heat sinks are configured such that the light emitting module and the optical module are directly mounted to the third heat sink when each of the first, second, and third heat sinks are used in the modular lighting apparatus, and the light emitting module and the optical module are directly mounted to second heat sink when the first and second heat sinks are used while the third heat sink is not used in the modular lighting apparatus.

14. A method of manufacturing a modular lighting apparatus, comprising:

configuring a heat radiating module to have a prescribed configuration that conforms to one of a plurality of prescribed standards;

assembling a light emitting module to the heat radiating module, the light emitting module including a substrate provided on the heat radiating module and at least one LED arranged on the substrate;

coupling a power module to the light emitting module, the light emitting module including a housing coupled to the heat radiating module and an electric unit provided in the housing to supply power to the light emitting module; and assembling an optical module to the heat radiating module, the optical module having a prescribed light emission pattern, height and diameter, wherein configuring the heat radiating module includes when the modular lighting apparatus is configured according to a first standard associated with a first product group, assembling the light emitting module directly on a first heat sink, the first heat sink having a height within a range of 45 mm to 50 mm, when the modular lighting apparatus is configured according to a second standard associated with a second product group, assembling a second heat sink directly to the first heat sink, the second heat sink having a height within a range of 20 mm to 25 mm, and when the modular lighting apparatus is configured according to a third standard associated with a third product group, assembling a third heat sink directly to the second heat sink which is mounted to the first heat sink, the third heat sink having a height in the range of 18 mm to 22 mm.

15. The method according to claim 14, wherein the standards include American National Standards Institute (ANSI) C78.20 and C78.21, and wherein a sum of the height of the first heat sink, the height of the second heat sink, and the height of the third heat sink is within a range of 85 mm to 95 mm.

16. The method according to claim 15, wherein the modular lighting apparatus configured according to the first standard conforms to standards for product groups of at least one of A19, A21, P25, G30, PAR20, PAR30S, or R20.

17. The method according to claim 15, wherein the modular lighting apparatus configured according to the second standard conforms to standards for product groups of at least one of A23, PAR30L, BR30, PAR38, or BRL 38.

18. The method according to claim 15, wherein the modular lighting apparatus configured according to the third standard conforms to standards for product groups of at least one of ER40, BR40, R40, PS25, or PS30.

19. The method according to claim 14, wherein the modular lighting apparatus is a bulb type or a Parabolic Aluminized Reflector (PAR) type that conform to ANSI standards based on a light emission angle and a shape of the optical module, and wherein a height and a diameter of the optical module is selected to conform to an ANSI standard corresponding to a prescribed product group.

20. The method according to claim 14, wherein the first, second, and third heat sinks are configured such that the light emitting module and the optical module are directly mounted to the third heat sink when each of the first, second, and third heat sinks are used in the modular lighting apparatus, and the light emitting module and the optical module are directly mounted to second heat sink when the first and second heat sinks are used while the third heat sink is not used in the modular lighting apparatus.

* * * * *